US009291158B2

(12) United States Patent
Cochran et al.

(10) Patent No.: US 9,291,158 B2
(45) Date of Patent: Mar. 22, 2016

(54) OVERMOLDED DIAPHRAGM PUMP

(75) Inventors: Bryan C. Cochran, Lakeville, MN (US); Dawn P. Svenkeson-Koubal, Mound, MN (US); Todd L. Johnson, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 747 days.

(21) Appl. No.: 13/265,016

(22) PCT Filed: Apr. 21, 2010

(86) PCT No.: PCT/US2010/031846

§ 371 (c)(1),
(2), (4) Date: Oct. 18, 2011

(87) PCT Pub. No.: WO2010/123965

PCT Pub. Date: Oct. 28, 2010

(65) Prior Publication Data

US 2012/0036995 A1 Feb. 16, 2012

Related U.S. Application Data

(60) Provisional application No. 61/172,004, filed on Apr. 23, 2009.

(51) Int. Cl.
*F04B 43/02* (2006.01)
*F04B 39/12* (2006.01)

(52) U.S. Cl.
CPC ..... *F04B 43/02* (2013.01); *F04B 39/125* (2013.01); *F05C 2253/04* (2013.01); *F05C 2253/22* (2013.01)

(58) Field of Classification Search
CPC .... F04B 39/125; F04B 43/02; F05C 2253/22; F05C 2253/04
USPC ..... 92/96, 98 R, 103 R, 103 B, 47, 169.1, 92/169.2; 29/888.02; 417/395, 423.14
See application file for complete search history.

(56) References Cited

U.S. PATENT DOCUMENTS 4,252,510 A 2/1981 Bromley
4,472,115 A 9/1984 Rupp
(Continued)

FOREIGN PATENT DOCUMENTS

CN 87212875 10/1988
EP 0716230 A2 6/1996
(Continued)

OTHER PUBLICATIONS

This invention improves upon the Graco Husky 1040 Polypropylene pump, manual provided.
International Search Report, International Application No. PCT/US2010/031846, dated Mar. 31, 2011, 3 pages.
(Continued)

*Primary Examiner* — Nathaniel Wiehe
*Assistant Examiner* — Logan Kraft
(74) *Attorney, Agent, or Firm* — Kinney & Lange, P.A.

(57) ABSTRACT

The fluid section of an air operated double diaphragm pump 10 consists of two fluid housings 12, an inlet manifold 14, and an outlet manifold 16. The housings are to be made in two parts. The preferred frame 18 material is glass fiber reinforced with polypropylene that is overmolded into final shape with an encapsulating material 20. The frame 18 is designed so that the encapsulating material 20 can flow from one side to the other allowing for a mechanical lock between the top surface 22 and the bottom so as not to rely on chemical adhesion between the two materials.

5 Claims, 2 Drawing Sheets

(56) References Cited

U.S. PATENT DOCUMENTS

| | | | | |
|---|---|---|---|---|
| 4,478,560 | A | 10/1984 | Rupp | |
| 4,639,029 | A * | 1/1987 | Kolonia | 294/57 |
| 5,324,755 | A * | 6/1994 | Kilius et al. | 523/214 |
| 5,391,060 | A | 2/1995 | Kozumplik, Jr. et al. | |
| 5,567,130 | A | 10/1996 | Kvinge et al. | |
| 5,649,809 | A | 7/1997 | Stapelfeldt | |
| 6,464,475 | B1 * | 10/2002 | Bertolini | 417/437 |
| 6,962,487 | B2 | 11/2005 | Caldwell | |
| 2002/0057972 | A1 * | 5/2002 | Barinaga et al. | 417/413.3 |
| 2004/0047749 | A1 | 3/2004 | Roberts et al. | |
| 2006/0174945 | A1 * | 8/2006 | Maula et al. | 137/341 |
| 2007/0092385 | A1 | 4/2007 | Petrie Pe | |
| 2008/0017653 | A1 * | 1/2008 | Carter | 220/723 |

FOREIGN PATENT DOCUMENTS

| | | |
|---|---|---|
| JP | 2005214034 | 8/2005 |
| WO | WO 2006127380 | 11/2006 |
| WO | 2009-037234 | 3/2009 |

OTHER PUBLICATIONS

International Preliminary Report on Patentability, International Application No. PCT/US2010/031846, dated Oct. 25 2011, 6 pages.

State Intellectual Property Office of People's Republic of China, First Office Action, Application No. 201080017187.6 dated Oct. 30, 2013, 5 pages.

English Translation of Office Action, Japanese Application No. 2012-507336, dated Dec. 4, 2013, 1 page.

English Translation of Office Action, Russian Application No. 2011147458, dated Dec. 26, 2013, 1 page.

State Intellectual Property Office of People's Republic of China, Second Office Action, Application No. 201080017187.6 dated Jun. 16, 2014, 9 pages.

Australian Patent Examination Report No. 1, Australian Application No. 2010239346, dated Oct. 13, 2014, 6 pages.

English Translation of Office Action, Taiwanese Application No. 099112503, dated Dec. 9, 2014, 3 pages.

English Translation of Office Action, Taiwanese Application No. 099112503, dated Jun. 23, 2015, 2 pages.

* cited by examiner

OVERMOLDED DIAPHRAGM PUMP

TECHNICAL FIELD

This application claims the benefit of U.S. application Ser. No. 61/172,004, filed Apr. 23, 2009, the contents of which are hereby incorporated by reference.

BACKGROUND ART

Plastic diaphragm pumps have traditionally been molded from a resin which may have reinforcing fibers therein.

DISCLOSURE OF THE INVENTION

It is an object of this invention to reduce the amount of higher cost material in the construction of components utilized in air operated double diaphragm pumps. It is further desired to increase the mechanical strength and stiffness of the components utilized in air operated double diaphragm pumps. Yet another goal is to eliminate the common issue of bolt torque relaxation caused by material deforming under load. It is also a goal to avoid adding reinforcing fillers to the material in contact with the fluid. Other prior art designs obtain the other goals by simply adding reinforcing filler to the entire part.

The fluid section of an air operated double diaphragm pump consists of two fluid housings, an inlet manifold, and an outlet manifold. The primary focus (but not limited to) of this invention is to make improvements to the fluid housings and the manifolds. The parts are to be made in two steps: a molded inner frame and an overmolded final shape. The preferred frame material is fiber reinforced plastic (specifically fiber reinforced plastics—glass fiber reinforced polypropylene and carbon fiber reinforced PVDF) that is overmolded into the final shape with polypropylene, conductive polypropylene, or PVDF. Acetal is another option.

The frame is designed so that the encapsulating material can flow from one side to the other allowing for a mechanical lock between the top surface and the bottom so as not to rely on chemical adhesion between the two materials.

An alternative to the preferred method of total overmold of the frame would be to laminate to the material contact surface or "wetted portion" of the frame only with any of the three compatible materials listed above.

Estimates for a 1" diaphragm pump show use about one pound less of acetal or PVDF used per fluid cover. There will be decreased molding time (dwell time) in the mold due to thinner parts. The design allows decreased ribbing which allows for easier exterior cleaning. The invention provides increased part stability leading to less deformation of base material while part is in use. The frame material is not in contact with the fluid being pumped.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
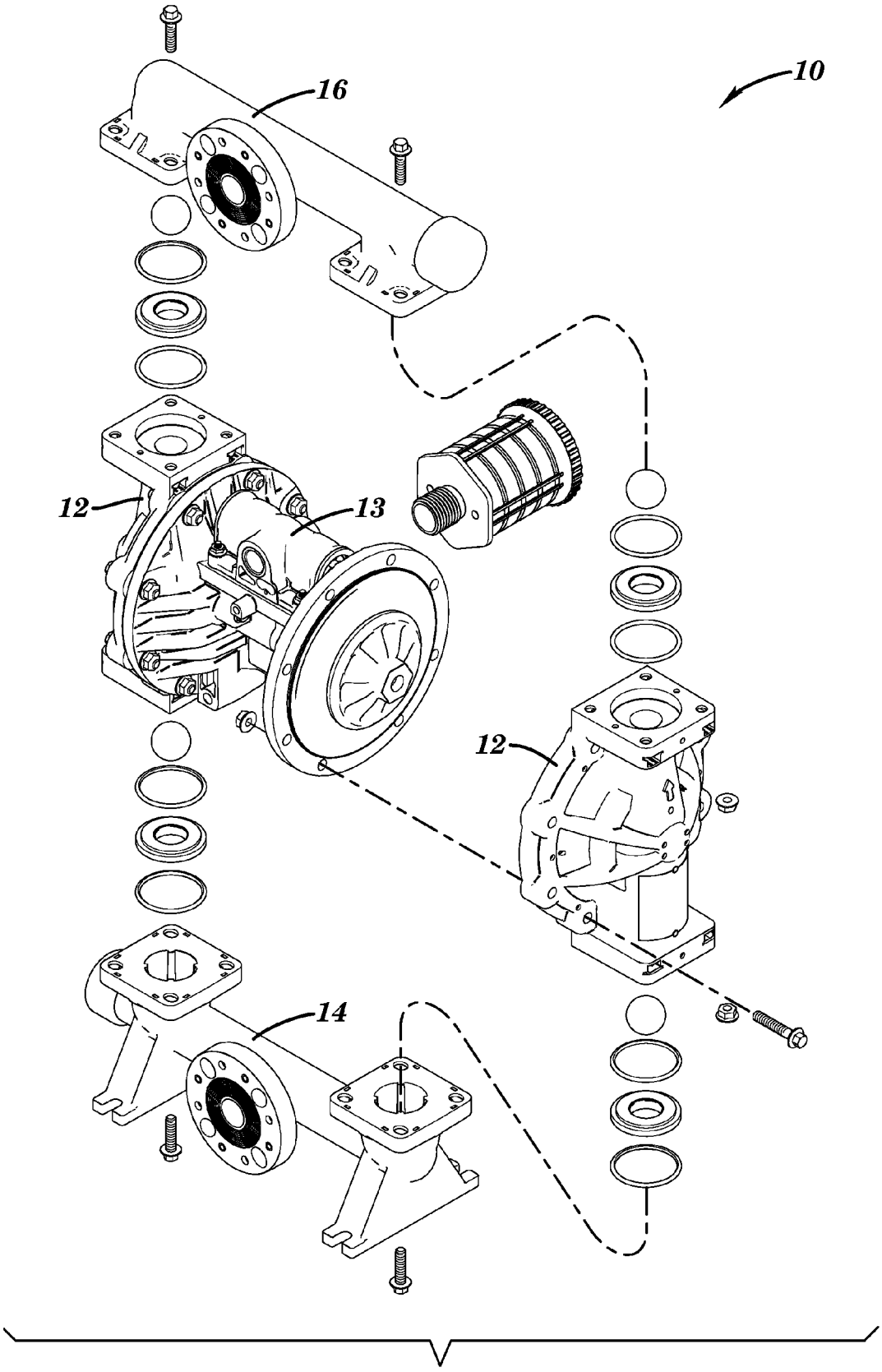
FIG. 1 shows a partially exploded view of an air operated double diaphragm pump.

The fluid section of an air operated double diaphragm pump 10 consists of two fluid housings 12, a center section 13, an inlet manifold 14, and an outlet manifold 16. The primary focus (but not limited to) of this invention is to make improvements to the fluid housing 12 and manifolds 14 and 16, collectively fluid carrying parts. The housings (fluid, manifolds or other) are to be made in two parts. The preferred frame 18 material is fiber reinforced plastic (specifically fiber reinforced plastics—glass fiber reinforced polypropylene and carbon fiber reinforced PVDF) that is overmolded into the final shape with an encapsulating material such as polypropylene, conductive polypropylene, or PVDF. Acetal is another option.

Figure 3:
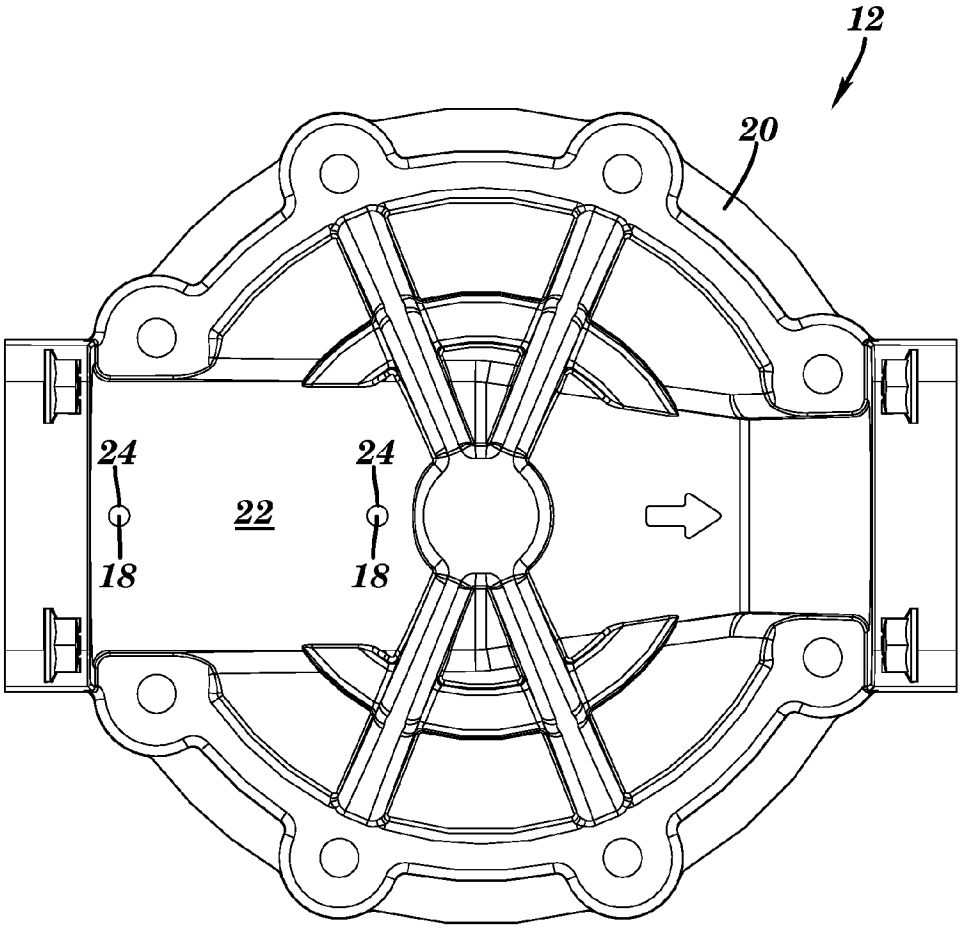
FIG. 3 shows an external view of a fluid housing molded according to the instant invention.
Figure 2:
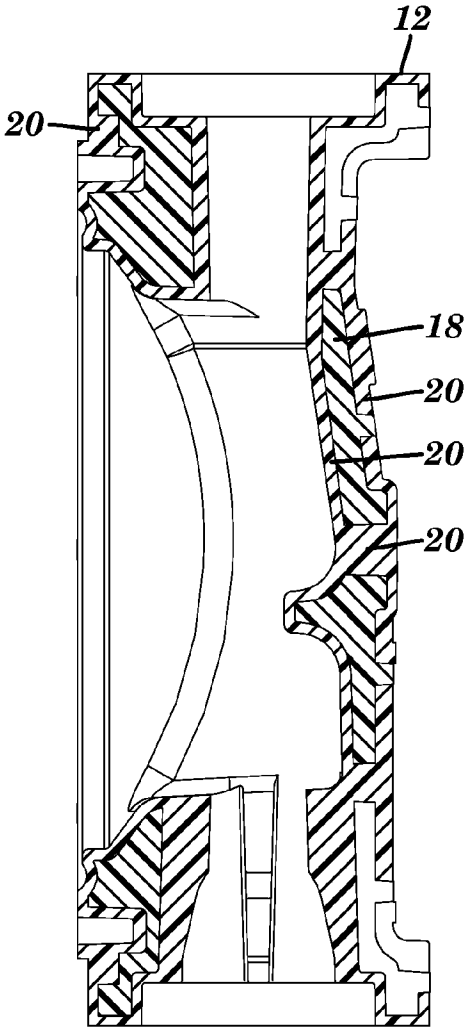
FIG. 2 shows a cross-section of a fluid housing molded according to the instant invention.

The frame 18 is designed so that the encapsulating material 20 can flow from one side to the other allowing for a mechanical lock between the top surface 22 and the bottom so as not to rely on chemical adhesion between the two materials. Note how FIG. 3 shows bonding portions 24 extending to the surface 22. This construction eliminates any concern with delamination of the two materials, which may be cause by chemical attack or mechanical stress.

An alternative to the preferred method of total overmold of the frame would be to laminate to the material contact surface or "wetted portion" of the frame only with any of the three compatible materials listed above.

It is contemplated that various changes and modifications may be made to the pump parts without departing from the spirit and scope of the invention as defined by the following claims.

The invention claimed is:

1. A diaphragm pump comprising:

a center section comprising a diaphragm;

an inlet manifold comprising a molded inlet frame, said molded inlet frame having an overmolded inlet encapsulation, said overmolded inlet encapsulation covering said inlet frame where said inlet manifold is configured to contact a fluid being pumped;

an outlet manifold comprising a molded outlet frame, said molded outlet frame having an overmolded outlet encapsulation, said overmolded outlet encapsulation covering said outlet frame where said outlet manifold is configured to contact the fluid being pumped;

at least one fluid housing disposed between the inlet manifold and the outlet manifold and secured to the center section, the fluid housing comprising a molded housing frame, said molded housing frame having an overmolded housing encapsulation, said overmolded housing encapsulation completely covering said molded housing frame where said fluid housing is configured to contact the fluid being pumped; and at least one bonding portion extending from the molded housing frame and extending through a top surface of the overmolded housing encapsulation, wherein the at least one bonding portion extends through the top surface in an area not contacting the fluid being pumped and opposite a portion of the overmolded housing encapsulation configured to contact the fluid being pumped;

wherein said at least one bonding portion comprises an upper surface, the upper surface extending through the top surface and being parallel to the top surface, the upper surface being a solid surface extending across the entire bonding portion;

wherein said molded housing frame is molded from a fiber reinforced plastic.

2. The diaphragm pump of claim 1 wherein said fiber reinforced plastic is selected from the group consisting of glass fiber reinforced polypropylene and carbon fiber reinforced PVDF.

3. The diaphragm pump of claim 1 wherein said housing encapsulation is molded from a plastic.

4. The diaphragm pump of claim 3 wherein said housing encapsulation is selected from the group consisting of polypropylene, conductive polypropylene, PVDF and acetal.

5. The diaphragm pump of claim 1 wherein the housing frame further comprises:

an aperture extending through a central portion of the housing frame;

wherein the encapsulating material extends through the aperture to form a mechanical lock between the encapsulating material disposed on the top surface of the fluid housing and the encapsulating material disposed on a bottom surface of the fluid housing.

* * * * *

UNITED STATES PATENT AND TRADEMARK OFFICE

CERTIFICATE OF CORRECTION

PATENT NO. : 9,291,158 B2
APPLICATION NO. : 13/265016
DATED : March 22, 2016
INVENTOR(S) : Cochran et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this
Twenty-sixth Day of July, 2016

Michelle K. Lee

Michelle K. Lee
*Director of the United States Patent and Trademark Office*